US011273333B2

(12) United States Patent
Sabolis et al.

(10) Patent No.: US 11,273,333 B2
(45) Date of Patent: Mar. 15, 2022

(54) RESPIRATOR WITH PHASE CHANGE MATERIAL

(71) Applicant: Scott Technologies, Inc., Boca Raton, FL (US)

(72) Inventors: Alyssa Whitney Sabolis, Weddington, NC (US); Michael Parham, Weddington, NC (US); Amy Elizabeth Quiring, Matthews, NC (US); Ethan David Voss, Charlotte, NC (US); Antti Seppälä, Vaasa (FI); Gareth Roberts, Wrexham (GB); Graham Peter Wilson, Flintshire (GB); Troy Alan Baker, St. Asaph (GB); Carl Escort Tucker, Conwy (GB)

(73) Assignee: Scott Technologies, Inc., Monroe, NC (US)

( * ) Notice: Subject to any disclaimer, the term of this patent is extended or adjusted under 35 U.S.C. 154(b) by 708 days.

(21) Appl. No.: 14/852,986

(22) Filed: Sep. 14, 2015

(65) Prior Publication Data

US 2016/0001101 A1 Jan. 7, 2016

Related U.S. Application Data

(63) Continuation of application No. PCT/US2014/028153, filed on Mar. 14, 2014.
(Continued)

(51) Int. Cl.
*A62B 9/00* (2006.01)
*A41D 13/11* (2006.01)
(Continued)

(52) U.S. Cl.
CPC ..... *A62B 9/003* (2013.01); *A41D 13/1153* (2013.01); *A41D 13/1161* (2013.01);
(Continued)

(58) Field of Classification Search
CPC ..... A61M 16/06–0655; A61M 16/0683–0694; A61M 2016/0661;
(Continued)

(56) References Cited

U.S. PATENT DOCUMENTS 4,951,664 A * 8/1990 Niemeyer ..... A62B 18/025 128/205.27
5,415,222 A * 5/1995 Colvin ..... A41D 13/0053 165/136
(Continued)

FOREIGN PATENT DOCUMENTS

CN 201161072 Y 12/2008
CN 201453869 U 5/2010
(Continued)

OTHER PUBLICATIONS

US 8,196,585 B2, 06/2012, Gilliver (withdrawn)
(Continued)

*Primary Examiner* — Michelle J Lee
(74) *Attorney, Agent, or Firm* — Christopher & Weisberg, P.A.

(57) ABSTRACT

A respirator includes a frame, a filter layer, and a face seal member. The frame has an outer side and an inner side. The frame defines an opening therethrough. The filter layer is mounted to the outer side of the frame and covers the opening of the frame. The filter layer is configured to prohibit permeation of aerosol, gas, and/or vapor contaminants therethrough. The face seal member is mounted to the inner side of the frame. The face seal member includes a seal contact area configured to engage a facial surface of a wearer. The face seal member incorporates a phase change material therein. The phase change material is configured to provide localized cooling by absorbing heat emitted by the wearer.

11 Claims, 7 Drawing Sheets

Related U.S. Application Data

(60) Provisional application No. 61/794,226, filed on Mar. 15, 2013, provisional application No. 61/794,054, filed on Mar. 15, 2013, provisional application No. 61/781,464, filed on Mar. 14, 2013.

(51) Int. Cl.

| | |
|---|---|
| ***A62B 9/02*** | (2006.01) |
| ***A62B 18/02*** | (2006.01) |
| ***A62B 18/08*** | (2006.01) |
| ***A62B 23/02*** | (2006.01) |
| *A62B 7/10* | (2006.01) |
| *A62B 17/00* | (2006.01) |
| *A62B 17/04* | (2006.01) |

(52) U.S. Cl.
CPC ..... *A62B 9/02* (2013.01); *A62B 18/02* (2013.01); *A62B 18/08* (2013.01); *A62B 18/082* (2013.01); *A62B 23/025* (2013.01); *A62B 7/10* (2013.01); *A62B 17/005* (2013.01); *A62B 17/04* (2013.01)

(58) Field of Classification Search
CPC ..... A62B 7/00–14; A62B 18/00–084; A62B 9/00–06; A62B 23/00–025; A62B 17/005; A62B 17/04; A41D 13/11–1192
See application file for complete search history.

(56) References Cited

U.S. PATENT DOCUMENTS

| | | | | |
|---|---|---|---|---|
| 5,647,226 | A * | 7/1997 | Scaringe | C09K 5/066 62/371 |
| 5,804,297 | A | 9/1998 | Colvin | |
| 5,955,188 | A | 9/1999 | Pushaw | |
| 6,132,455 | A | 10/2000 | Shang | |
| 6,152,137 | A | 11/2000 | Schwartz | |
| 6,183,855 | B1 | 2/2001 | Buckley | |
| 6,257,235 | B1 | 7/2001 | Bowen | |
| 6,397,847 | B1 | 6/2002 | Scarberry | |
| 6,689,466 | B2 | 2/2004 | Hartmann | |
| 6,699,266 | B2 | 3/2004 | Lachenbruch | |
| 7,086,400 | B2 * | 8/2006 | Shigematsu | A41D 13/11 128/205.25 |
| 7,114,496 | B1 | 10/2006 | Stein | |
| 7,135,424 | B2 | 11/2006 | Worley | |
| 7,237,550 | B1 * | 7/2007 | Lin | A62B 18/025 128/205.27 |
| 7,793,372 | B2 | 9/2010 | Lean | |
| D656,231 | S | 3/2012 | Hill | |
| 8,297,285 | B2 | 10/2012 | Henry | |
| 8,573,201 | B2 | 11/2013 | Hill | |
| 8,636,007 | B2 | 1/2014 | Hill | |
| D709,181 | S | 7/2014 | Hill | |
| 2003/0088019 | A1 | 5/2003 | Pause | |
| 2005/0051171 | A1 | 3/2005 | Booth | |
| 2005/0089185 | A1 | 4/2005 | Allen | |
| 2008/0047560 | A1 * | 2/2008 | Veliss | A61M 16/0605 128/206.24 |
| 2008/0289633 | A1 | 11/2008 | Kwok | |
| 2009/0032024 | A1 | 2/2009 | Burz | |
| 2010/0024811 | A1 | 2/2010 | Henry | |
| 2011/0277769 | A1 * | 11/2011 | Teng | A62B 23/025 128/206.21 |
| 2011/0296584 | A1 * | 12/2011 | Kuo | A41D 13/1161 2/206 |
| 2012/0070606 | A1 | 3/2012 | Villata | |
| 2012/0080035 | A1 | 4/2012 | Guney | |
| 2012/0111330 | A1 * | 5/2012 | Gartner | A61M 16/161 128/205.23 |
| 2012/0125341 | A1 * | 5/2012 | Gebrewold | A41D 13/1146 128/206.12 |
| 2012/0149795 | A1 | 6/2012 | Schleiermacher | |
| 2012/0204881 | A1 * | 8/2012 | Davidson | A61M 16/06 128/206.25 |
| 2012/0285448 | A1 * | 11/2012 | Dugan | A61M 16/06 128/202.16 |
| 2013/0174333 | A1 | 7/2013 | Schwartz | |
| 2015/0197610 | A1 | 7/2015 | Peterson | |
| 2015/0238725 | A1 * | 8/2015 | Tucker | A61F 7/02 600/26 |
| 2016/0008566 | A1 | 1/2016 | Partington | |
| 2016/0183610 | A1 | 6/2016 | Ying | |

FOREIGN PATENT DOCUMENTS

| | | | |
|---|---|---|---|
| CN | 102698349 | A | 10/2012 |
| CN | 202476508 | U | 10/2012 |
| DE | 102007042733 | A1 | 6/2008 |
| EP | 0356000 | A2 | 2/1990 |
| EP | 2283901 | A1 | 2/2011 |
| EP | 2428240 | A1 | 3/2012 |
| EP | 2828240 | A1 | 1/2015 |
| KR | 100660605 | B1 | 12/2006 |
| WO | 9947010 | A1 | 9/1999 |
| WO | 2009042208 | A1 | 4/2009 |
| WO | 2011006206 | A1 | 1/2011 |
| WO | WO 2013/107095 | | 7/2013 |
| WO | WO 2016/054692 | | 4/2016 |

OTHER PUBLICATIONS

Supplementary European Search Report and European Search Opinion dated Oct. 12, 2016 for European Application Serial No. 14768861.8, Filing Date: Jan. 20, 2016, consisting of 13-pages.
International Search Report and Written Opinion dated Jul. 17, 2014 for International Application Serial No. PCT/US2014/028153 International Filing Date: Mar. 14, 2014, consisting of 12-pages.
Chinese Office Action, Search Report and translations thereof dated Apr. 8, 2018 issued in corresponding Chinese Application Serial No. 201480025320.0, consisting of 16 pages.

* cited by examiner

RESPIRATOR WITH PHASE CHANGE MATERIAL

CROSS-REFERENCE TO RELATED APPLICATIONS

This application is a continuation of International Patent Application No. PCT/US2014/028153 filed Mar. 14, 2014, which claims priority to U.S. Provisional Application No. 61/781,464, filed Mar. 14, 2013, entitled "Face Masks," U.S. Provisional Application No. 61/794,054, filed Mar. 15, 2013, entitled "Face Masks," and U.S. Provisional Application No. 61/794,226, filed Mar. 15, 2013, entitled "Face Masks." All of the aforementioned applications are incorporated herein by reference.

BACKGROUND OF THE DISCLOSURE

Embodiments of the present disclosure generally relate to respirators, and more particularly to respirators that have phase change material to provide thermoregulation for comfort of the respirator wearer.

Typical respirator masks include a protective shell, such as a non-permeable shield or a semi-permeable filter member, that covers the nose and mouth of the wearer to prohibit splatter and contaminants in the air from being inhaled by the wearer. Edges of the respirator typically contact the face of the wearer to seal to the face to prohibit the entrance of un-filtered air into the respirator. The inside of the respirator may define a cavity or a dead space. The air that the wearer breathes is inhaled from the cavity and exhaled to the cavity. Although the respirator may include filter media and/or a valve to allow for air exchange through the respirator, such as to discharge carbon dioxide and to receive oxygen, a substantial amount of exhaled air may be at least temporarily trapped within the cavity of the respirator.

The exhaled air includes heat, moisture, and carbon dioxide. As the heat and moisture builds within the cavity, the wearer may feel hot and sweaty along the nose and mouth, including the facial surfaces that contact the edges of the respirator, and may feel that the air is very stuffy and difficult to breathe. Valves, such as inhalation and exhalation valves, may not sufficiently dissipate the heat and moisture that cumulates to relieve the discomfort experienced by the wearer. In an effort to relieve the discomfort, the wearer may opt to remove the respirator and continue in a task without wearing the respirator. However, removing the respirator exposes the person no longer wearing the respirator to the contaminants in the air, such as fomites, air pollutants, splatter of hazardous chemicals, and the like, which may be harmful if inhaled.

SUMMARY OF THE DISCLOSURE

In an embodiment, a respirator includes a frame, a filter layer, and a face seal member. The frame has an exposed outer side and an enclosed inner side. The frame defines an opening therethrough. The filter layer is mounted to the frame and covers the opening of the frame. The filter layer is configured to prohibit permeation of aerosol contaminants therethrough. The face seal member is mounted to the inner side of the frame. The face seal member includes a seal contact area configured to engage a facial surface of a wearer. The face seal member incorporates a phase change material therein. The phase change material is configured to provide localized cooling by absorbing heat emitted by the wearer.

In certain aspects, the phase change material is at least one of encapsulated by a primary material of the face seal member or micro-encapsulated in a polymer coating prior to being incorporated into the primary material. The primary material may be at least one of a silicone or a thermoplastic elastomer.

In certain aspects, the phase change material melts at a temperature between 30° C. and 40° C. In certain aspects, the phase change material is incorporated into the seal contact area of the face seal member and absorbs heat to provide cooling to the facial surface that engages the seal contact area. In some embodiments, the phase change material is at least one of a paraffin, a fatty acid, or a salt hydrate. In certain aspects, a phase change of the phase change material occurs at a temperature that is proximate to at least one of an exhalation air temperature of the wearer or a body temperature of the wearer.

In some embodiments, the frame is at least partially convex and a cavity is formed between the filter layer and the face seal member. The phase change material may be incorporated into at least one of the filter layer or the face seal member proximate to the cavity such that the phase change material absorbs heat from air within the cavity to provide cooling of the air inside the respirator.

In certain aspects, the respirator further includes a harness assembly that includes one or more straps configured to removably mount the respirator to a head of the wearer. At least one of the straps or a harness cradle of the harness assembly may incorporate the phase change material therein to provide localized cooling to the head of the wearer by absorbing heat emitted from the head.

In certain aspects, the face seal member includes a formable nasal member that is bendable to conform to a nasal area of the wearer. The nasal member may incorporate the phase change material therein to provide cooling to the facial surface of the wearer within the nasal area.

In certain aspects, the respirator is at least one of disposable or semi-disposable.

In certain aspects, in low ambient temperatures the melted phase change material solidifies and releases heat to provide heating for the wearer.

In an embodiment, a respirator includes a frame, an oronasal member, and a harness assembly. The oronasal member is mounted to the frame. The oronasal member is configured to surround the nasal and oral regions of a wearer. The oronasal member includes a seal contact area configured to engage a facial surface of the wearer. The harness assembly has one or more straps coupled to at least one of the frame or the oronasal member. The harness assembly is configured to removably mount the respirator to a head of the wearer. At least one of the frame, the oronasal member, or the harness assembly includes a phase change material incorporated therein. The phase change material is configured to provide localized cooling by absorbing heat emitted by the wearer, the phase change material melting at a temperature that is proximate to at least one of an exhalation air temperature of the wearer or a body temperature of the wearer.

In certain aspects, the phase change material is encapsulated by the at least one of the frame, the oronasal member, or the harness assembly that incorporates the phase change material or is micro-encapsulated in a polymer coating prior to being incorporated into the at least one of the frame, the oronasal member, or the harness assembly.

In certain aspects, the oronasal member is formed of a filter media that is configured to prohibit permeation of aerosol contaminants therethrough. In certain aspects, the oronasal member is formed of at least one of a silicone, polyisoprene, halo-butyl, or a thermoplastic elastomer.

In some embodiments, the frame is a shield formed of non-permeable plastic. The respirator may further include at least one valve to allow for air exchange through the respirator. The at least one valve may include a filter media configured to prohibit permeation of aerosol contaminants therethrough.

In certain aspects, the respirator further includes a rear-facing filter member. The rear-facing filter member may be disposed rearward of the frame and at least one of leftward, rightward, or downward of the seal contact area of the oronasal member.

In certain aspects, the frame includes an exhalation valve.

In certain aspects, the oronasal member has a convex structure that forms a cavity therein. The phase change material may be incorporated into the oronasal member proximate to the cavity such that the phase change material absorbs heat from air within the cavity to provide cooling of the air inside the respirator.

In certain aspects, the phase change material is incorporated into the seal contact area of the oronasal member and absorbs heat to provide cooling to the facial surface that engages the seal contact area.

In some embodiments, the respirator is a half-face respirator. In certain aspects, the respirator is at least one of a full-face respirator or an inner mask component of at least one of a full face piece or a hood respirator assembly.

In certain aspects, the respirator further includes a lens mounted to the frame and an outer sealing member that is mounted to at least one of the lens or the frame. The outer sealing member may include a seal contact area configured to engage at least one of a forehead, a cheek, or a chin surface of the wearer. The phase change material may be incorporated into the outer sealing member and may absorb heat from the at least one of the forehead, the cheek, or the chin surface of the wearer that engages the seal contact area.

In certain aspects, the outer sealing member is formed of at least one of a silicone, polyisoprene, halo-butyl, or a thermoplastic elastomer.

In certain aspects, the respirator further includes a lens mounted to the frame. The lens may be disposed over at least eyes of the wearer and may be clear to allow the wearer to see through the lens. The phase change material may be incorporated into the lens to provide cooling of air inside the respirator.

In certain aspects, at least some of the phase change material melts upon absorbing heat emitted by the wearer, and in low ambient temperatures the melted phase change material solidifies and releases heat to provide heating for the wearer.

DETAILED DESCRIPTION

Figure 2:
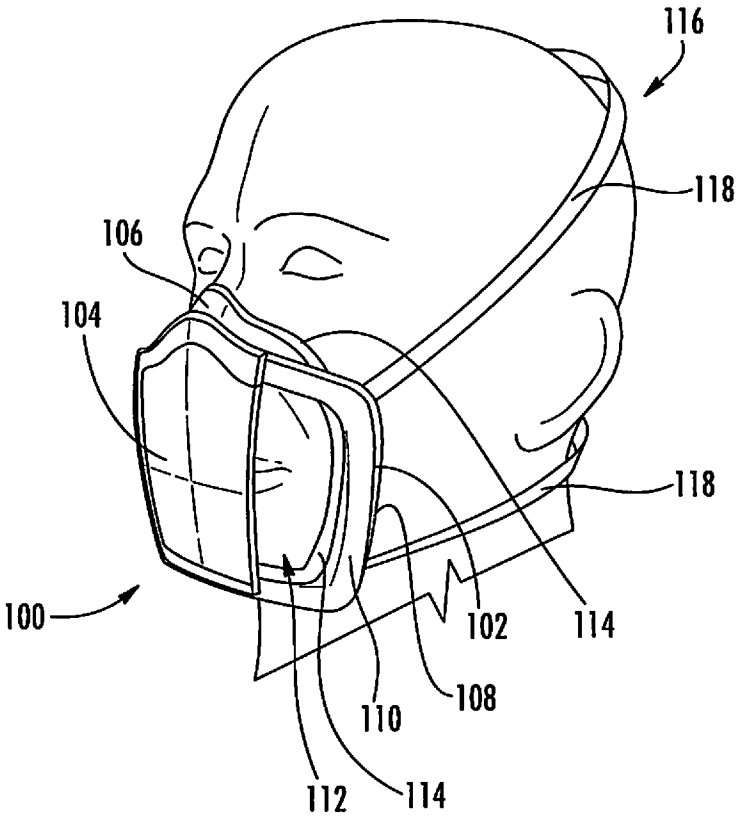
FIG. 2 illustrates the respirator shown in FIG. 1 with a partially cut-away filter layer.
Figure 1:
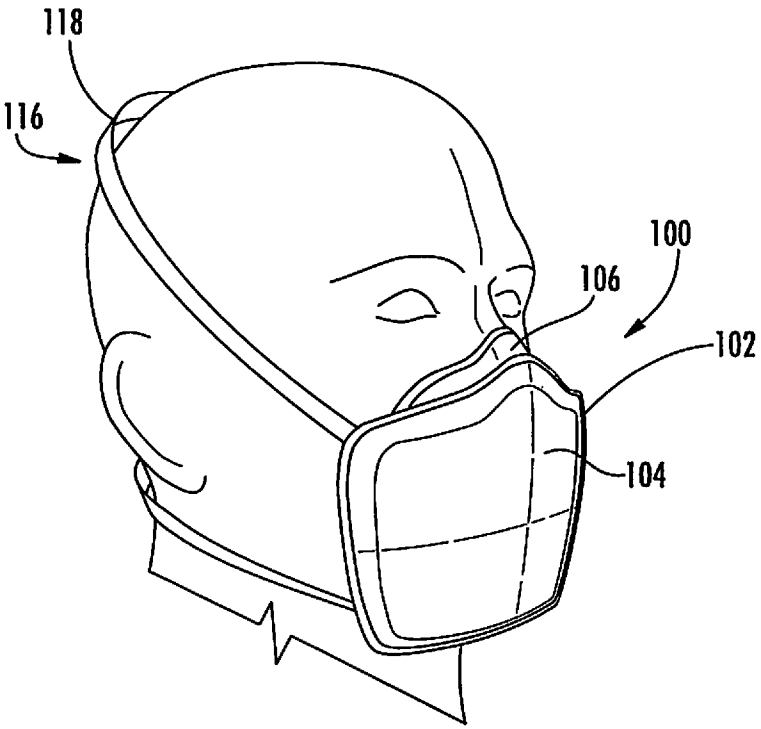
FIG. 1 is perspective view of a respirator in accordance with an embodiment of the inventive subject matter.

FIG. 1 is perspective view of a respirator 100 in accordance with an embodiment herein. The respirator 100 includes a frame 102, a filter layer 104, and a face seal member 106. FIG. 2 illustrates the respirator 100 shown in FIG. 1 with a partially cut-away filter layer 104 for descriptive purposes. The following description refers to both FIGS. 1 and 2.

The respirator 100 may be a mask worn by a person, referred to herein as a wearer. The respirator 100 may be configured to protect the wearer from harmful contaminants, such as particulates, fumes, vapors, gases, and/or splattered liquids in the environment around the wearer by shielding the nose and mouth of the wearer to prohibit the wearer from inhaling or ingesting the harmful contaminants. The air supplied through the respirator 100 to the wearer may be filtered and at least partially purified by the respirator 100 prior to inhalation. The respirator 100 shown in FIGS. 1 and 2 is a half-face mask, such that the respirator 100 covers the nasal and oral regions of the wearer while exposing other portions of the face, such as the eyes, ears, and other facial surfaces of the wearer. Although at least some of the embodiments shown and described herein are directed to a half-face respirator, in other embodiments, the respirator 100 may be or may be used in a full-face respirator that covers at least most of the face and/or the head. For example, the respirator 100 may be an inner mask component of a full face piece or hood respirator assembly.

In one or more embodiments, the respirator 100 may be disposable or semi-disposable. A disposable respirator is configured to be disposed in its entirety after one or more uses by a wearer. A semi-disposable respirator may be at least partially disassembled or deconstructed, and at least some parts of the respirator may be disposed and other parts of the respirator may be sterilized or decontaminated before being reassembled with one or more new disposable parts for a subsequent use by a wearer.

The frame 102 may have an enclosed, inner side 108 and an exposed, outer side 110, with an opening 112 that extends through the frame 102 between the inner and outer sides 108, 110. The terms "inner" and "outer" are defined relative to the facial surface of the wearer (who is currently wearing the respirator 100), such that the inner side 108 of the frame 102 faces toward the wearer and is within the decontaminated facial area while the outer side 110 faces away from the wearer and is exposed to the environment. The frame 102 may be configured to provide structure and some rigidity to the respirator 100 to allow the respirator 100 to retain a defined shape. In an embodiment, the frame 102 may be at least partially convex, such that the frame 102 slopes or bulges outward away from the wearer. The opening 112 of the frame 102 optionally may occupy a majority of the area of the frame 102, such that the frame 102 itself forms a border around the opening 112.

The filter layer 104 may be mounted to the frame 102 such that the filter layer 104 covers the opening 112. In an embodiment, the filter layer 104 is mounted to the outer side 110 of the frame 102. The filter layer 104 seals to the frame 102 such that no gaps extend between the filter layer 104 and the frame 104 around the perimeter of the filter layer 104, and any air that enters the respirator 100 through the opening 112 in the frame 102 must permeate through the filter layer 104. The filter layer 104 may be semi-permeable and configured to allow some permeation of air therethrough while prohibiting permeation of aerosol contaminants with the air. As such, the filter layer 104 filters the air that permeates through the filter layer 104.

The face seal member 106 may be mounted to the frame 102. For example, the face seal member 106 may be mounted to the inner side 108 of the frame 102 while the filter layer 104 is mounted to the outer side 110. The face seal member 106 is designed to surround both the nasal and oral regions of the wearer. As used herein, the face seal member 106 may be referred to as an oronasal member 106. The face seal member 106 includes a seal contact area 114 that is configured to engage a facial surface of the wearer. For example, the seal contact area 114 may extend along a perimeter of the face seal member 106. The seal contact area 114 may contact the cheeks, the chin, and the nose of the wearer when the respirator 100 is worn by the wearer. The seal contact area 114 is configured to seal to the facial surfaces of the wearer to prohibit the passage of air between the face seal member 106 and the face of the wearer, as such air may be un-filtered and include harmful contaminants.

The respirator 100 also may include a harness assembly 116. The harness assembly 116 includes one or more straps 118 configured to removably mount the respirator 100 to a head of the wearer. The one or more straps 118 may be coupled to the frame 102 and/or the face seal member 106. The one or more straps 118 provide tension to hold the face seal member 106 in contact with the facial surface of the wearer to seal the respirator 100 to the wearer. The one or more straps 118 may be stretchable and/or include one or more adjustable straps to allow for a customized fit of the respirator 100 on the wearer. Optionally, the harness assembly 116 may include a harness cradle 160 (shown in FIG. 14) that couples two straps 118 together along the sides or the back of the head of the wearer and provides a preset spacing between the two straps 118.

In an embodiment, at least one of the frame 102, the face seal member 106, the filter layer 104, or the harness assembly 116 includes a phase change material (PCM) incorporated therein.

The phase change material may be of any known phase change material chemistry including, but not limited to, organic substrates, inorganic substrates, and mixtures of both. By way of example, the phase change material may be at least one of a paraffin, a fatty acid, or a salt hydrate. Paraffin and fatty acids are organic, and salt hydrates are inorganic. The phase change material may have a high heat of fusion such that the material is capable of storing and releasing large amounts of energy. The phase change material may be selected or modified in order for the phase change material to change phase at a temperature or range of temperatures that includes or is proximate to the air temperature of the air exhaled by the wearer and/or the body temperature of the wearer (or, more specifically, the temperature at the facial surface of the wearer). For example, the exhalation air temperature may be around 34° C. and the body temperature of the wearer may be around 37° C. As such, the phase change material may be configured to change phase (for example, absorb or release latent energy) at a temperature between 30° C. and 40° C., and more preferably between 33° C. and 38° C. In an embodiment, the phase change material changes between solid and liquid states in this temperature range, but in other embodiments using other phase change materials, the phase change may be between liquid and gaseous states.

In an embodiment, the phase change material may be micro-encapsulated in a polymer coating prior to being incorporated into a component of the respirator 100. After micro-encapsulation, the phase change material may be co-molded with one or more of the components of the respirator 100 to form the respective component(s). In an alternative embodiment, the phase change material may be encapsulated by the primary material of the corresponding component of the respirator 100 (without first being encapsulated in a separate polymer coating). The components of the respirator 100 that may incorporate the phase change material include, for example, the face seal member 106, the frame 102, the filter layer 104, the harness assembly 116, and the like. The encapsulation of the phase change material prevents leakage of the phase change material out of the incorporated component(s). For example, the phase change material may be co-molded with silicone, polyisoprene, halo-butyl, and/or a thermoplastic elastomer to form the face seal member 106. The face seal member 106 may also be formed of a closed-cell polyurethane foam, and the phase change material incorporated therein.

Alternatively, or in addition, the phase change material may be integrated directly into the filter layer 104 during formation of the filter material. For example, the phase change material may be incorporated into an open-cell polyurethane foam that provides a breathing pathway. Thus, as described above the incorporation of phase change material may be integral integration during a forming process of a component of the respirator 100.

In an alternative embodiment, the phase change material may be incorporated onto a component of the respirator 100 after the component is formed by bonding a bed of phase change material to the component. For example, a patch or bed of phase change material may be bonded to the interior surface of the filter layer 104 that at least partially defines the cavity 128. Since the phase change material itself may be harmful if contacted against the skin directly, the phase change material optionally may be disposed on a component that does not contact the wearer directly or may be covered with an intermediate material that is safe to the touch but also allows thermal transfer between the facial surface of the wearer and the phase change material.

The phase change material is configured to provide thermoregulation at the boundary of contact between the wearer's face and at the boundary of contact between the wearer's face and the respirator 100. For example, the phase change material may provide localized cooling for the wearer by absorbing heat emitted by the wearer. The heat may be direct conductive heat emitted by a skin surface of the wearer directly into a component of the respirator 100 that engages the skin surface or convective heat that is absorbed from air exhaled from the wearer into the respirator 100. The phase change material may be configured to absorb heat without exhibiting a substantial increase in temperature by undergoing a phase change. For example, the heat that is absorbed is used to change the phase of at least some of the phase change material from a solid to a liquid phase. Latent heat is used to change the phase of the material and does not increase the temperature of the material. The temperature at which the phase change material melts, or changes from a solid to a gel or to a liquid, depends on the properties of the phase change material. In an embodiment, the phase change material that is incorporated into the respirator 100 melts at a temperature that is proximate to an exhalation air temperature of the wearer and/or a body temperature of the wearer.

As the phase change material absorbs heat and changes state, the facial surfaces and/or air proximate to the phase change material is cooled as the heat is dissipated away from the facial surfaces and/or air in the respirator 100. Thus, the incorporation of the phase change material may improve comfort of the wearer while wearing the respirator 100. Increased comfort of the wearer while wearing the respirator 100 reduces the urge or tendency of the wearer to remove the respirator 100 (or not even put on the respirator 100 in the first place) out of discomfort.

As stated above, the phase change material provides thermoregulation, and not only cooling. Thus, the phase change material may also provide heating to the air within the respirator 100 and/or the skin, surfaces of the wearer based on the thermal conditions of the wearer and the ambient environment. For example, the phase change material may be in a liquid or gel state after absorbing heat emitted from the wearer. However, if the wearer enters an environment that is below a certain temperature, the phase change material may begin to undergo a reverse phase change process that causes the melted phase change material to return to a solid state. As the phase change material solidifies, heat is released from the phase change material, and the heat may be absorbed by the skin surfaces of the wearer and/or the air in the respirator 100 to provide localized heating. The release of heat may provide comfort to a wearer who is working outside, for example, in freezing or at least low temperatures. Thus, although one or more embodiments described herein are directed to the ability of the phase change material to provide cooling, it is recognized that the phase change material may also be used in each embodiment to provide heating. The phase change material provides thermal regulation by absorbing heat from the wearer upon melting to cool the wearer when the wearer is hot, and releasing the absorbed heat to the wearer upon solidifying to heat the wearer when the environment is cold.

Figure 3:
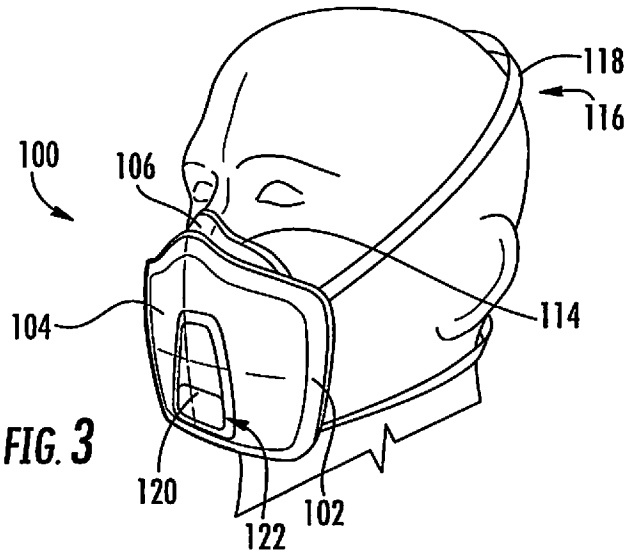
FIG. 3 is a perspective view of a respirator in accordance with another embodiment.
Figure 4:
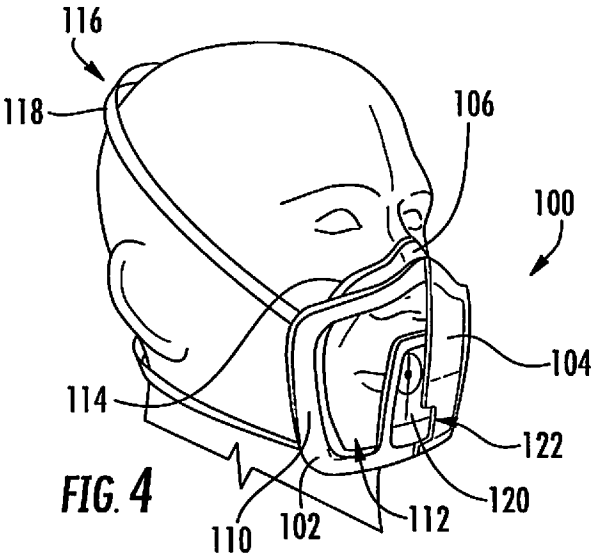
FIG. 4 illustrates the respirator shown in FIG. 3 with a partially cut-away filter layer.

FIG. 3 is a perspective view of the respirator 100 in accordance with another embodiment. The respirator 100 shown in FIG. 3 may be similar to the embodiment of the respirator 100 shown in FIG. 1, although the respirator 100 shown in FIG. 3 includes an exhalation valve 120 on the filter layer 104. FIG. 4 illustrates the respirator 100 shown in FIG. 3 with the filter layer 104 partially cut-away for descriptive purposes. The following description refers to both FIGS. 3 and 4.

The frame 102 of the respirator 102 may be formed of a plastic material. For example, the frame 102 may be formed by a molding process. Depending on the plastic material, the frame 102 may be flexible, semi-rigid, or rigid to provide structure to the respirator 102. The frame 102 optionally may be a five-sided structure. One or more support beams 168 (shown in FIG. 17) may extend across the opening 112 of the frame 102 to provide support for the filter layer 104 or a shield mounted to the frame 102.

The exhalation valve 120 of the frame 102 provides a port for the air that is exhaled from the wearer to exit the respirator 100. The exhalation valve 120 may be integral to the frame 102. Alternatively, the valve may be a snap-in valve. Optionally, the valve 120 may include an associated plenum that directs the air through a channel before or after flowing through the valve 120. The exhalation valve 120 may include filter media to prohibit outside air from entering the respirator 100 through the valve 120. Optionally, the exhalation valve 120 may be biased to open at a lower flow rate that is consistent with regular, non-elevated breathing rates (such as experienced by a healthcare worker). Resistance may be lower to ensure that a majority of the exhaled air exits through the exhalation valve instead of through inhalation filter media portions (for example, the filter layer 104) of the respirator 100. The exhalation filter media may have a targeted efficiency for filtering out larger biological contaminants (as compared to inhalation filter media used in an inhalation portion) in order to achieve the lower resistance. The exhalation filter media may also have a lower particulate loading capacity which is commensurate with the lower loading of biological particulate matter exhaled from the respirator 100 as opposed to the higher biological particulate loading in the ambient environment.

The filter layer 104 may include particulate filter media that is oriented into a textile or sheet. The filter layer 104 may include pleated or non-pleated electrostatic or synthetic membrane filter media. Synthetic membrane material may be re-usable due to being able to undergo common sterilization techniques. The filter layer 104 may be mounted to the outer side 110 of the frame 102 by insert molding, heat staking, ultrasonic welding, or the like. Optionally, the filter layer 104 may include an opening 122 at the exhalation valve 120 to allow the exhaled air to be discharged from the respirator 100. In one or more alternative embodiments, the outer layer of the respirator 100 may be a non-permeable or semi-permeable plastic shield instead of a filter layer 104, as described further herein.

The face seal or oronasal member 106 may be a formed of a silicone material, a thermoplastic elastomer material, and/or the like. The face seal member 106 may be molded such that the seal contact area 114 conforms around the nasal and oral regions of the wearer. The face seal member 106 optionally may be molded in a convex or c-shaped structure that bulges outward away from the wearer. Upon assembly of the respirator 100, the frame 102 and mounted filter layer 104 may be received over the face seal member 106. In an optional embodiment, the seal face member 106 may include one or more inhalation valves 152 (shown in FIG. 11) to regulate airflow into the respirator 100.

Optionally, the respirator 110 may be semi-disposable, and the face seal member 106 is removably mounted to the frame 102 and filter layer 104 to allow for disposal of the frame 102 and filter layer 104 and sterilization of the face seal member 106 and harness assembly 116. For example, the face seal member 106 may have integrated strap loops that are configured to receive the straps 118 of the harness assembly 116 therethrough. In another semi-disposable embodiment, the frame 102 and harness assembly 116 may be dismantled for sterilization while the filter layer 104 and face seal member 106 are disposed. In an alternative embodiment in which the respirator 100 is fully disposable, the face seal member 106 may incorporate the filter layer 104 and the combined material may be bonded to the frame 102, such as by heat staking, to construct the disposable respirator 100.

The one or more straps 118 of the harness assembly 116 may be formed at least partially of a stretchable material, such as neoprene, elastic, or the like. In other embodiments, the one or more straps 118 may not stretch, but may be coupled to adjustable coupling devices that allow the wearer to adjust the length of the one or more straps 118. For example, plastic buckles, hook and loop patches, "push to snap" butterfly clips, and other coupling devices may be located along the one or more straps 118. In an embodiment, the coupling device is located along the back of the neck of the wearer. In an embodiment, the harness assembly 116 may have a single strap 118 that loops twice around the head of the wearer, once along the bottom of the head or neck and again along the top of the head. The one or more straps 118 may have a single or double point attachment to the respirator 100. The one or more straps 118 optionally may include pads that provide padding for the wearer, and the pads may be formed of silicone, a thermoplastic elastomer, or the like. Optionally, the harness assembly 116 may include a harness cradle 160, as described further herein with reference to FIG. 14.

Figure 5:
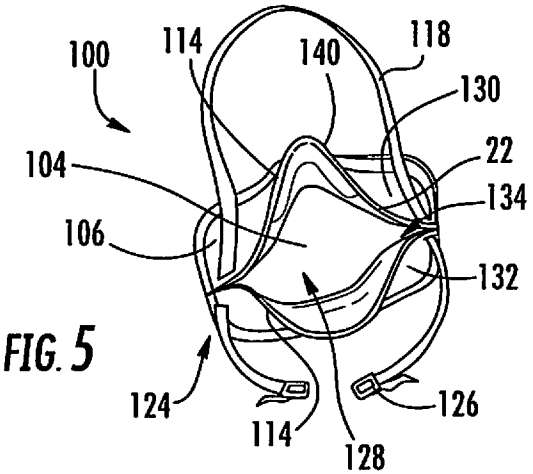
FIG. 5 illustrates an interior of a respirator according to an embodiment.
Figure 6:
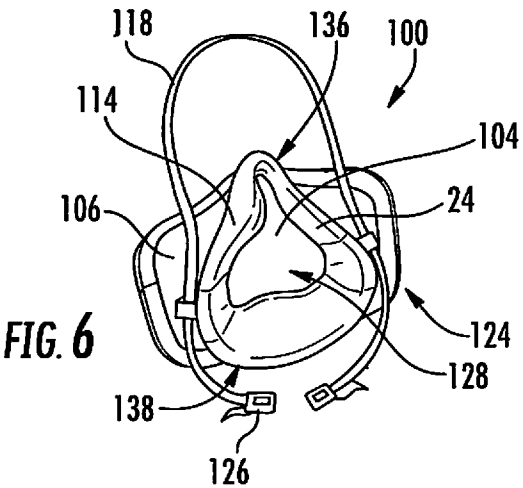
FIG. 6 illustrates an interior of a respirator according to another embodiment.

FIG. 5 illustrates an interior 124 of the respirator 100 according to an embodiment. FIG. 6 illustrates an interior 124 of the respirator 100 according to another embodiment. The following description refers to both FIGS. 5 and 6. The interior 124 of the respirator 100 shows the respirator 100 from the perspective of the wearer. Each of the respirators 100 shown in FIGS. 5 and 6 include a single strap 118 that is looped through the face seal or oronasal member 106 at two points, one point on each side of the seal contact area 114. The strap 118 has a buckle 126 that is used to removably couple the two ends of the strap 118. The length of the strap 118 may be adjustable using the buckle 126.

The inner region of the seal contact area 114 is open to allow the nose and mouth of the wearer to extend into the respirator 110 through the face seal member 106. The frame 102 and/or filter layer 104 may be at least partially convex and curved or bulged away from the face seal member 106 such that a cavity 128 is formed between the filter layer 104/frame 102 and the face seal member 106. The cavity 128 includes air that is to be inhaled by the wearer as well as air that is exhaled from the wearer. In an alternative embodiment, the frame 102 and/or filter layer 104 may not be convex but may be disposed a distance from the face seal member 106 such that the cavity 128 is formed.

The face seal member 106 shown in FIG. 5 includes an upper portion 130 and an opposing lower portion 132 that are separated by a horizontal slot 134. The upper and lower portions 130, 132 are pulled apart in opposing upward and downward directions to form the seal contact area 114. The face seal member 106 shown in FIG. 6 includes a one-piece molded seal contact area 114. The one-piece molded seal contact area 114 includes a narrow nasal area 136 that receives the bridge of the nose of the wearer and a wider oral area 138 that receives the mouth of the wearer. Although the face seal member 106 shown in FIG. 5 is not contoured to the facial features of the wearer like the face seal member 106 shown in FIG. 6, one or both of the face seal members 106 may include a formable nasal member 140 that allows for some customization of the fit between the seal contact area 114 and the nasal region of the wearer. As shown in FIG. 5, the nasal member 140 may be bendable or heat-treatable in order to provide a structure that conforms to the nasal region of the wearer and provides a better seal between the respirator 100 and the facial surfaces of the wearer.

In an embodiment, a phase change material is incorporated into one or more of the components of the respirator 100. For example, the phase change material may be incorporated into the seal contact area 114 of the face seal member 106. The phase change material on the seal contact area 114 may absorb heat directly from the skin of the wearer that engages the contact area 114. Alternatively, or in addition, the phase change material may be incorporated into the filter layer 104, the frame 102, and/or the face seal member 106 proximate to the cavity 128. As some examples, the phase change material may be incorporated into the filter later 104 that defines an outer wall of the cavity 128, the frame 102 which defines side walls of the cavity 128, and/or an outer surface of the face seal member 106 that defines an inner wall of the cavity 128. Incorporating the phase change material into surfaces that surround and define the cavity 128 allows heat from the air within the cavity 128 to be absorbed by the phase change material to cool the air within the respirator 100. Alternatively, or in addition, the phase change material may be incorporated into the formable nasal member 140 that is mounted to the seal contact area 114 in order to absorb heat directly from the nasal area of the wearer. Alternatively, or in addition, the phase change material may be incorporated in the strap 118 (or other components of the harness assembly 116 shown in FIG. 4) to provide localized cooling to the surface of the face and head of the wearer by directly absorbing heat emitted from areas under the strap 118.

FIGS. 7-18 show various alternative embodiments of the respirator 100 shown and described herein.

Figure 9:
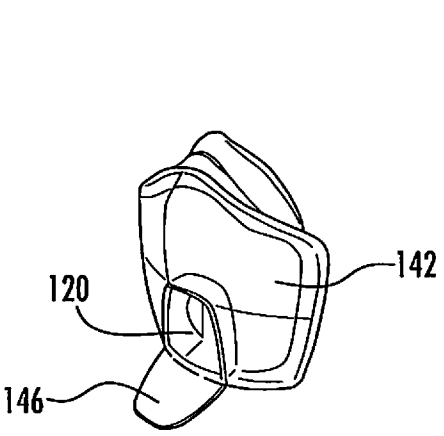
FIG. 9 is a front perspective view of the respirator shown in FIG. 7 according to an embodiment.
Figure 7:
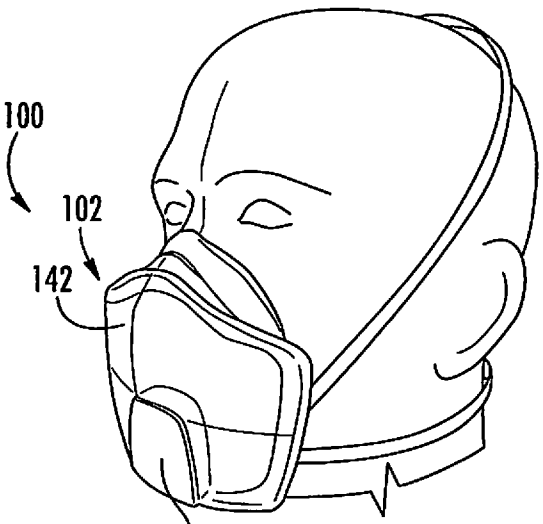
FIG. 7 is a front perspective view of a respirator in accordance with an embodiment.

FIG. 7 is a front perspective view of the respirator 100 in accordance with an embodiment. The frame 102 of the respirator 100 is or includes a shield 142, and a filter layer 104 (shown in FIG. 1) is not mounted to an outer side of the shield 142. The shield 142 may be formed of a non-permeable plastic material that captures splatter and prohibits contaminants from permeating therethrough. The shield 142 optionally may be transparent or semi-transparent (for example, translucent) to facilitate speech comprehension by allowing a visual indication of facial features. The shield 142 may include an exhalation valve 120. As shown in FIG. 9, the shield 142 has a door 146 that rotates open to allow exhaled air out of the valve 120 to be discharged through the shield 142 into the ambient environment. Optionally, phase change material may be incorporated into the shield 142 to provide thermoregulation of the respirator 100.

Figure 8:
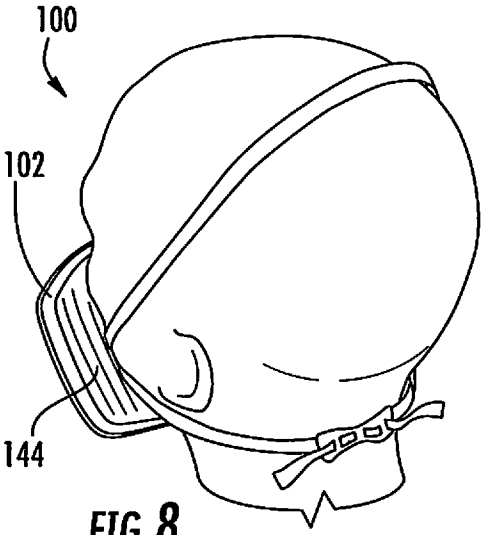
FIG. 8 is a rear perspective view of the respirator shown in FIG. 7.
Figure 10:
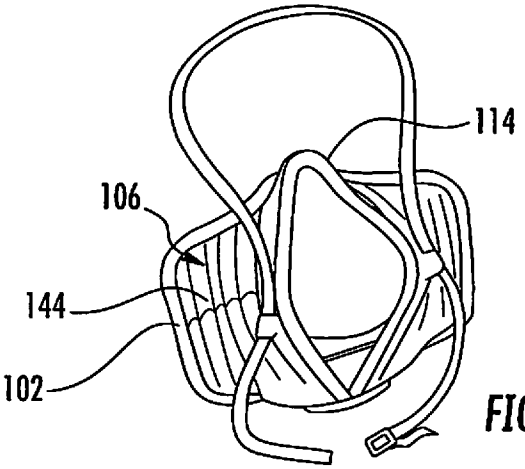
FIG. 10 illustrates the interior of the respirator shown in FIG. 7 according to an embodiment.

FIG. 8 is a rear perspective view of the respirator 100 shown in FIG. 7. The respirator 100 includes a rear-facing filter member 144. The rear-facing filter member 144 includes a filter media configured to allow for air exchange through the respirator 100 while prohibiting permeation of aerosol contaminants across the filter member 144. For example, the rear-facing filter member 144 may be an inhalation filter to allow filtered air into the respirator 100 for the wearer to breathe. The filter member 144 is rear-facing to avoid splash contamination directly onto the filter media and also to direct inhalation airflow to the wearer away from potential sources of aerosol hazards, such as patients with respiratory illnesses. Referring now to FIG. 10, which shows an interior of the respirator 100 shown in FIG. 7, the rear-facing filter member 144 may form at least part of the oronasal member 106 (or face seal member). As such, the oronasal member 106 may be formed of a filter media that is configured to prohibit the permeation of aerosol contaminants therethrough. The rear-facing filter member 144 may be disposed rearward of the frame 102 and extend between the frame 102 and the seal contact area 114 of the oronasal member 106. As shown in FIG. 10, the filter member 144 is disposed leftward and rightward of the seal contact area 114 from the perspective of the wearer. Optionally, the filter member 144 may also extend downward of the seal contact area 114 to allow air from around the neck and chin to be inhaled into the respirator 100 through the filter member 114.

Figure 11:
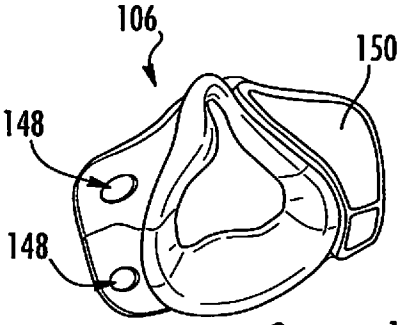
FIG. 11 illustrates the interior of the oronasal member of the respirator shown in FIG. 7 according to another embodiment.
Figure 11:
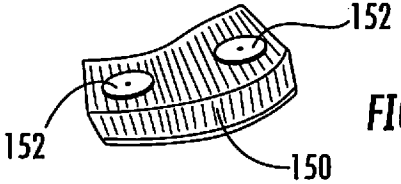

FIG. 11 illustrates the interior of the oronasal or face seal member 106 of the respirator 100 shown in FIG. 7 according to another embodiment. The oronasal or face seal member 106 may include mounting holes 148 configured to receive replaceable filter modules 150. The filter modules 150 may include inhalation valves 152 to better control air exchange within the respirator 100. The inhalation valves 152 may be used in addition to the exhalation valve 120 shown in FIGS. 7 and 9 to filter the air coming into and discharging out of the respirator 100. Like the rear-facing filter member 144 shown in FIG. 8, the filter modules 150 and incorporated inhalation valves 152 may be rear-facing to minimize capture of aerosol droplets and splatter from frontal facing work tasks.

Figure 13:
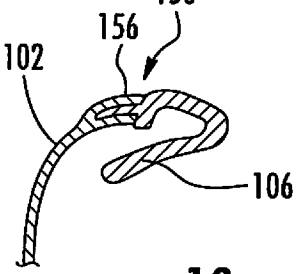
FIG. 13 illustrates a partial cross-section of the respirator shown in FIG. 12 showing an interface between an oronasal member and a shield.
Figure 12:
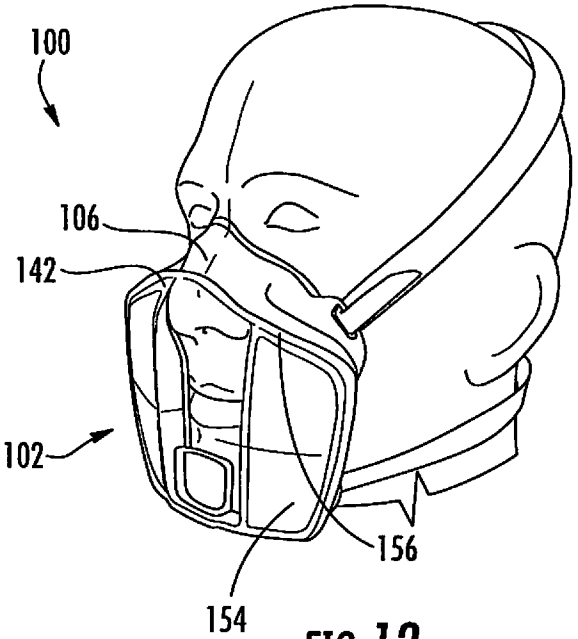
FIG. 12 is a front perspective view of a respirator in accordance with an embodiment.

FIG. 12 is a front perspective view of the respirator 100 in accordance with an embodiment. The frame 102 of the respirator 100 shown in FIG. 12 is or at least includes a shield 142. The frame 102 may include or house a front-facing filter member 154. The frame 102 may be mounted directly to the face seal or oronasal member 106 along a perimeter edge 156 of the frame 102 as shown in FIG. 13, which illustrates a partial cross-section of the interface 158 between the oronasal member 106 and the edge 156 of the frame 102 (for example, shield 142).

Figure 14:
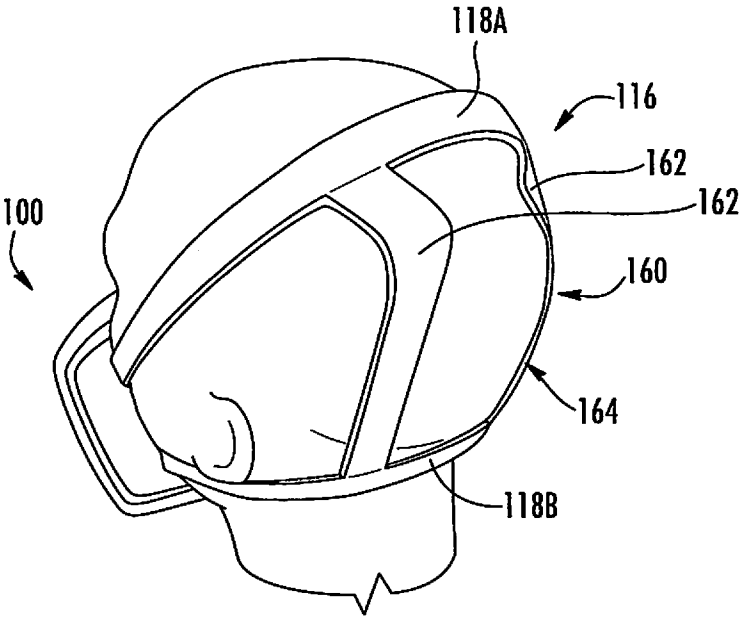
FIG. 14 is a rear perspective view of the respirator shown in FIG. 12.

FIG. 14 is a rear perspective view of the respirator 100 shown in FIG. 12. The harness assembly 116 of the respirator 100 includes a harness cradle 160. The harness cradle 160 is coupled to an upper strap 118A and a lower strap 118B to provide a predefined spacing between the upper and lower straps 118A, 118B. The harness cradle 160 may include one or more coupling straps 162 or panels. For example, the cradle 160 shown in FIG. 14 includes two coupling straps 162 and defines a space 164 therebetween. In another embodiment, the space 164 may be filled by a panel (not shown) which may have padding. The phase change material may be incorporated into the straps 118, the coupling straps 162, and/or the panel of the harness cradle 160. Furthermore, the phase change material may be incorporated into any padding or coupling devices (for example, the buckle 126 shown in FIG. 5) that are installed onto the harness cradle 160.

Figure 16:
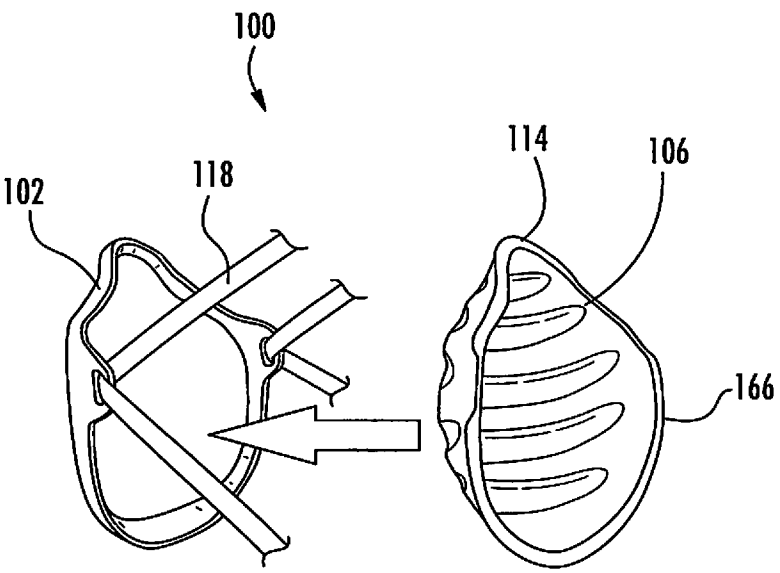
FIG. 16 is a partial deconstructed view of the respirator shown in FIG. 15.
Figure 15:
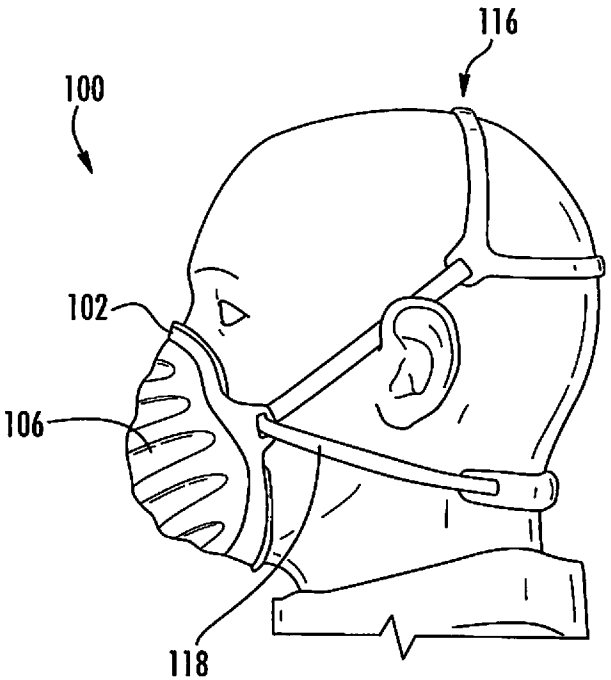
FIG. 15 is a side view of a respirator according to an embodiment.

FIG. 15 is a side view of the respirator 100 according to an alternative embodiment. FIG. 16 is a partial deconstructed view of the respirator 100 shown in FIG. 15. The respirator 100 shown in FIGS. 15 and 16 may be semi-disposable. For example, the oronasal or face seal member 106 may be a shaped molded cup (for example, having a convex shape) that is configured to insert into the frame 102. The oronasal member 106 may be formed of filter media, and optionally may include a foam gasket seal 166 at the seal contact area 114. Optionally, the foam gasket seal 166 may incorporate the phase change material therein. The frame 102 may be a semi-rigid plastic that has a dual function of supporting the oronasal member 106 in constant engagement with the facial surface of the wearer as well as conforms at least slightly to the contours of the face of the wearer to provide a better seal. The frame 102 may include plural contact points with the straps 118 of the harness assembly 116 to provide a balanced pulling force on the oronasal member 106.

Figure 18A:
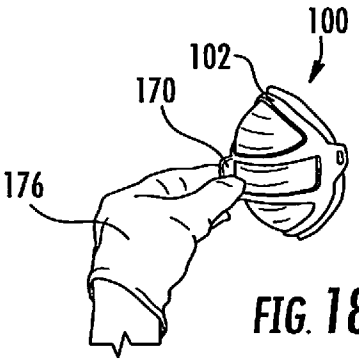
FIGS. 18A-18C show various steps for disposing the respirator shown in FIG. 17 according to an example disposal process; and, FIG. 19 is a front perspective view of the respirator according to an alternative embodiment.
Figure 18B:
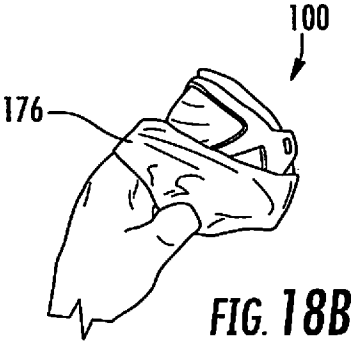
Figure 18C:
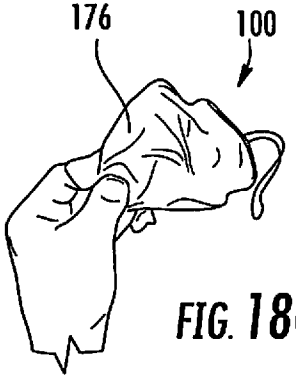
Figure 17:
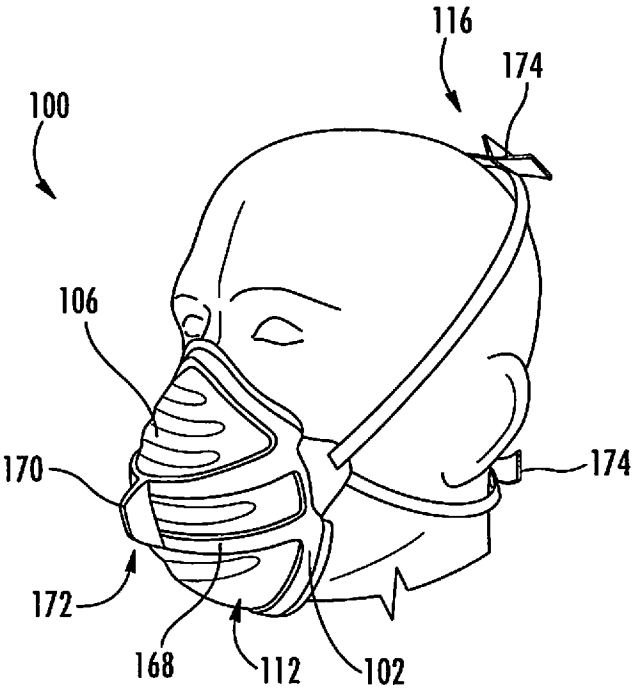
FIG. 17 is a perspective view of a respirator according to an embodiment.

FIG. 17 is a perspective view of the respirator 100 according to an embodiment. The respirator 17 optionally may be fully disposable. The frame 102 of the respirator 100 includes support beams 168 that span across the opening 112 of the frame 102 to provide support for the oronasal or face seal member 106. At least one support beam 168 includes an integrated handling tab 170 at a frontal end 172 of the respirator 100 that is located away from the head of the wearer. The tab 170 may be positioned in the center of the frame 102. The harness assembly 116 includes two butterfly clips 174. FIGS. 18A-18C show various steps for disposing the respirator 100 shown in FIG. 17 according to an example disposal process. In operation, once the wearer is finished wearing the respirator 100 and wants to discard the respirator 100 in a sanitary process, the wearer holds onto the frame 102 using the handling tab 170 (see FIG. 18A), and with the other hand snaps both butterfly clips 174 open, allowing the respirator 100 to be released from the head of the wearer. As the wearer (now former wearer) continues to hold the respirator 100 via the handling tab 170, with the other hand, the wearer starts to remove a disposable glove 176 (see FIG. 18B) from the hand holding the handling tab 170 and pulls the glove 176 over the respirator 100 and envelops the respirator 100 (see FIG. 18C). Once the respirator 100 has been covered by the glove 176, the respirator 100 is disposed.

Figure 19:
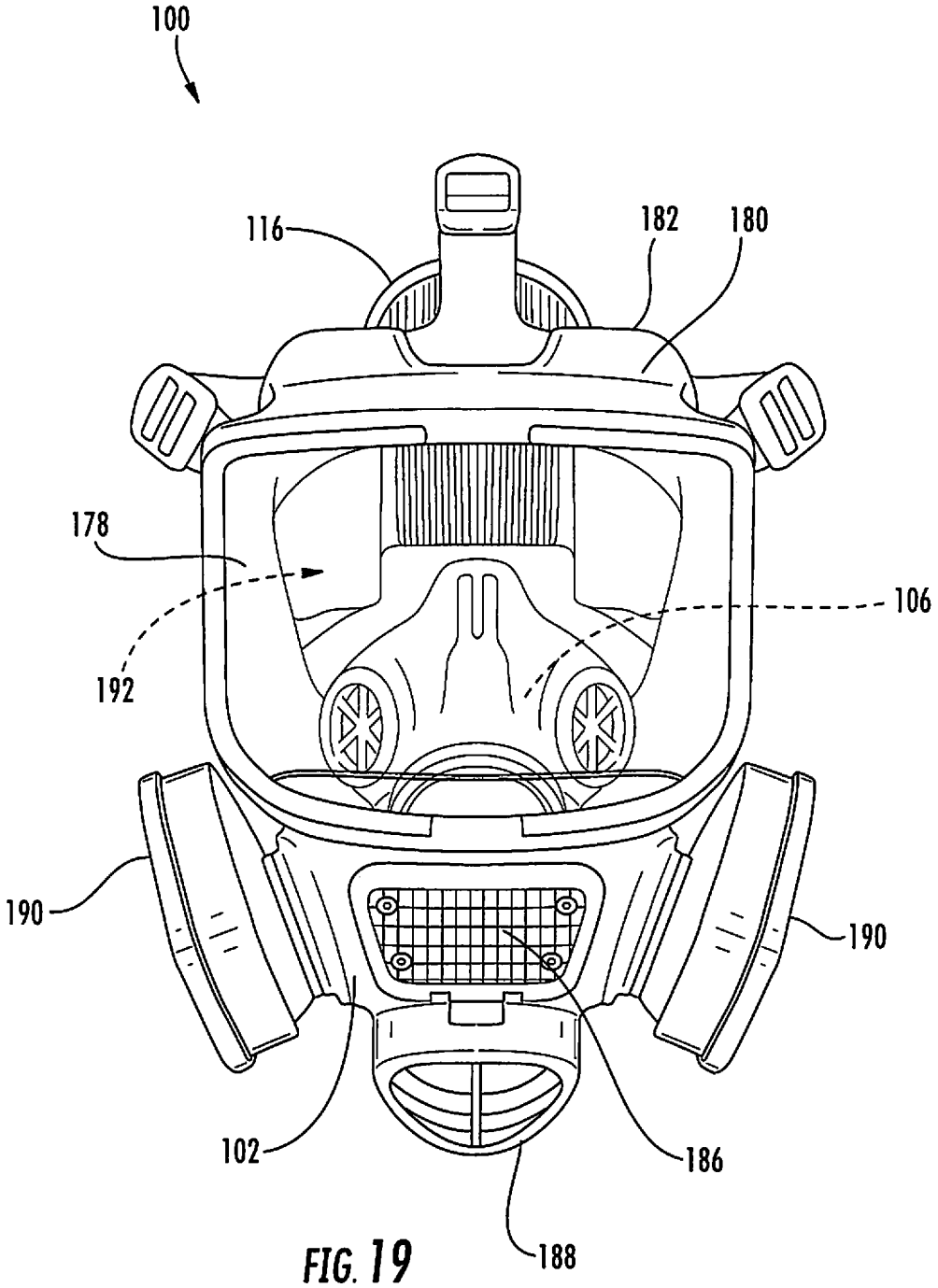

FIG. 19 is a front perspective view of the respirator 100 according to an alternative embodiment. The respirator 100 may be (or may be part of) a full face piece and/or a hood respirator assembly. The respirator 100 includes the frame 102, the oronasal member 106 which forms an inner face seal, a lens 178, an outer sealing member 180, the harness assembly 116, and a filter member (not shown). The frame 102 may provide structure to the respirator 100. The frame 102 may include a speech diaphragm 186, an exhalation valve assembly 188, and at least one inhalation valve assembly 190. The lens 178 is mounted to the frame 102. The lens 178 is configured to cover at least the eyes of the wearer and may be transparent or clear to allow the wearer to see through the lens 178. The lens 178 optionally may fully cover the full frontal facial region of the wearer.

The outer sealing member 180 is mounted to the frame 102. The outer sealing member 180 is formed of silicone, polyisoprene, halo-butyl, a thermoplastic elastomer, combinations thereof, or the like. The outer sealing member 180 includes a seal contact area 182 that is configured to engage a facial surface of the wearer. For example, the seal contact area 182 may contact a perimeter the face of the wearer, including but not limited to the forehead, cheeks, chin, and neck areas. The oronasal member 106 is mounted to the frame 102 and/or the outer sealing member 180. The oronasal member 106 is configured to surround and engage the nasal and oral regions of the wearer. The harness assembly 116 has one or more straps coupled to at least one of the frame 102, the lens 178, or the outer sealing member 180.

The filter member (not shown) may be mounted within a defined opening in the frame 102 and/or the lens 178. For example, the filter member may be mounted within the inhalation valve assembly 190 and/or the exhalation valve assembly 188. The filter member may be a filter layer or a filter cartridge, depending on the placement and application. The filter member 184 is configured to prohibit permeation of aerosol, gas, and/or vapor contaminants therethrough.

At least one of the frame 102, the lens 178, the outer sealing member 180, the oronasal member 106, the harness assembly 116, or the filter member (not shown) includes a phase change material incorporated therein. The phase change material is configured to provide localized cooling by absorbing heat emitted by the wearer. The phase change material may be configured to melt at a temperature that is proximate to an exhalation air temperature of the wearer and/or a body temperature of the wearer. For example, phase change material incorporated into the outer sealing member 180 to absorb heat directly from the forehead, cheeks, chin, and/or neck of the wearer. In another example, the phase change material may be incorporated into the lens 178 to absorb heat from air within the respirator 100, such as air between the lens 178 and the facial surfaces of the wearer. The air may be within a cavity 192 that has a perimeter defined by the outer sealing member 180.

In accordance with one or more embodiments described herein, a respirator is provided that affords, among other technical effects, the technical effect of providing thermoregulation of areas in and on the respirator to provide comfort for the wearer of the respirator. One or more embodiments provide a technical effect of absorbing heat emitted by a facial surface of the wearer to provide cooling for the wearer. A technical effect may also include releasing heat onto a facial surface of the wearer and/or into air within the respirator when the ambient temperature is low to provide heating for the wearer. A technical effect of the respirator providing cooling and/or heating for the wearer is that the wearer will be more comfortable wearing the respirator, and will be more inclined to wear the respirator while exposed to aerosol, gas, and/or vapor contaminants in the air. A further effect of wearing the respirator will be that the wearer is less likely to be harmed by the contaminants in the air.

While various spatial and directional terms, such as front, back, left, right, lower, upper, horizontal, vertical, and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions, types of materials and coatings described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112(f), unless and until such claim limitations expressly use the phrase "means for" followed by a statement of function void of further structure.

What is claimed is:

1. A respirator comprising:

a phase change material;

a frame having an outer side and an enclosed inner side, the frame defining an opening therethrough, the frame being at least partially convex such that the outer side bulges outward, the frame incorporating the phase change material, the phase change material incorporated in the frame configured to absorb heat from air exhaled by a wearer into the respirator;

a filter layer having an exterior side and an interior side opposite the exterior side, the filter layer being directly mounted to the outer side of the frame, the interior side of the filter layer covering the opening of the frame, the filter layer configured to prohibit permeation of aerosol contaminants therethrough, the filter layer incorporating the phase change material therein, the phase change material being integrated with the filter layer, the phase change material integrated with the filter layer configured to absorb heat from air exhaled by the wearer into the respirator;

and a face seal member mounted directly to the inner side of the frame, the face seal member including a seal contact area configured to engage a facial surface of the wearer, the face seal member being composed of a primary material of at least one of silicone, polyisoprene, halo-butyl, a thermoplastic elastomer, and a closed-cell polyurethane foam, the face seal member being co-molded with the phase change material, the phase change material that is co-molded with the face seal member being configured to provide localized cooling by absorbing heat emitted by skin of the wearer.

2. The respirator of claim 1, further comprising a harness assembly including one or more straps configured to removably mount the respirator to a head of the wearer.

3. The respirator of claim 2, wherein at least one of the straps or a harness cradle of the harness assembly incorporates the phase change material therein to provide localized cooling to the head of the wearer by absorbing heat emitted from the head.

4. The respirator of claim 1, wherein the phase change material of the face seal member is at least one of encapsulated by the primary material of the face seal member or microencapsulated in a polymer coating prior to being incorporated into the primary material.

5. The respirator of claim 1, wherein the phase change material is configured to melt at a temperature between 30° C. and 40° C.

6. The respirator of claim 1, wherein the phase change material is incorporated into the seal contact area of the face seal member and is configured to absorb heat to provide cooling to the facial surface that engages the seal contact area.

7. The respirator of claim 1, wherein a cavity is formed between the filter layer and the face seal member, the phase change material incorporated into the face seal member proximate to the cavity such that the phase change material is configured to absorb heat from air within the cavity to provide cooling of air inside the respirator.

8. The respirator of claim 1, wherein the phase change material is at least one of a paraffin, a fatty acid, or a salt hydrate.

9. The respirator of claim 1, wherein a phase change of the phase change material is configured to occur at a temperature that is proximate to at least one of an exhalation air temperature of the wearer or a body temperature of the wearer.

10. The respirator of claim 1, wherein at least some of the phase change material is configured to melt upon absorbing heat emitted by the wearer, and in low ambient temperatures the melted phase change material is configured to solidify and release heat to provide heating for the wearer.

11. A respirator comprising:

a phase change material;

a frame having an outer side and an enclosed inner side, the frame defining an opening therethrough, the frame being at least partially convex such that the outer side bulges outward, the frame incorporating the phase change material, the phase change material incorporated in the frame configured to absorb heat from air exhaled by a wearer into the respirator;

a filter layer having an exterior side and an interior side opposite the exterior side, the filter layer being directly mounted to the outer side of the frame, the interior side of the filter layer covering the opening of the frame, the filter layer configured to prohibit permeation of aerosol contaminants therethrough, the filter layer including the phase change material; and a face seal member mounted to the inner side of the frame, the face seal member including a seal contact area configured to engage a facial surface of the wearer, the frame defining a cavity between the filter layer and the face seal member, the phase change material being comolded with the face seal member and integrated with the filter layer and causing the filter layer to be configured to absorb heat from air exhaled by the wearer within the cavity to provide cooling of air inside the respirator.

* * * * *